US008062054B2

(12) United States Patent
Su et al.

(10) Patent No.: US 8,062,054 B2
(45) Date of Patent: Nov. 22, 2011

(54) CABLE CONNECTOR ASSEMBLY WITH IMPROVED STRUCTURE STRENGTH THEREOF

(75) Inventors: Ping-Sheng Su, Tu-Cheng (TW); Xue-Chao Wang, Kunshan (CN); Zhuang-Zhi Wu, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/853,459

(22) Filed: Aug. 10, 2010

(65) Prior Publication Data

US 2011/0034063 A1 Feb. 10, 2011

(30) Foreign Application Priority Data

Aug. 10, 2009 (CN) ..... 2009 2 0307688

(51) Int. Cl.
*H01R 13/627* (2006.01)

(52) U.S. Cl. ..... 439/362; 439/607.45

(58) Field of Classification Search ..... 439/362, 439/399, 607.44, 607.45, 607.47, 687, 607.41, 439/465, 953
See application file for complete search history.

(56) References Cited

U.S. PATENT DOCUMENTS

| | | | | |
|---|---|---|---|---|
| 5,820,412 | A * | 10/1998 | Koegel et al. | 439/607.51 |
| 6,210,230 | B1 | 4/2001 | Lai | |
| 6,705,894 | B1 * | 3/2004 | Comerci et al. | 439/607.47 |
| 6,821,140 | B2 * | 11/2004 | Wu | 439/362 |
| 6,988,908 | B2 | 1/2006 | Zhang et al. | |
| 7,033,202 | B2 * | 4/2006 | Wu | 439/362 |
| 7,086,889 | B2 * | 8/2006 | Yin et al. | 439/358 |
| 7,377,799 | B2 * | 5/2008 | Kuo | 439/362 |
| 7,416,449 | B2 * | 8/2008 | Kuo et al. | 439/607.41 |
| 7,491,083 | B2 * | 2/2009 | Shi et al. | 439/358 |
| 7,544,084 | B1 * | 6/2009 | Dutton et al. | 439/465 |
| 7,857,636 | B2 * | 12/2010 | Su et al. | 439/76.1 |
| 7,878,855 | B2 * | 2/2011 | Li | 439/607.45 |
| 2009/0215290 | A1 * | 8/2009 | Zhu et al. | 439/76.1 |

* cited by examiner

*Primary Examiner* — Hae Moon Hyeon
(74) *Attorney, Agent, or Firm* — Wei Te Chung; Andrew C. Cheng; Ming Chieh Chang

(57) ABSTRACT

A cable connector assembly (100) includes a top cover (11) defining at least one first positioning post (118) extending downwardly, a bottom cover (12) being assembled to the top cover (11) in an upper-to-lower direction thereof, an electrical connector (4) including an insulative housing (40) having a plurality of terminals (41) received therein; and at least one insulator (3) cooperates with the top cover (11) and the bottom cover (12) to define a retaining space (10) to retain the electrical connector (4) therein.

17 Claims, 5 Drawing Sheets

CABLE CONNECTOR ASSEMBLY WITH IMPROVED STRUCTURE STRENGTH THEREOF

BACKGROUND OF THE INVENTION

1. Field of the Invention

The present invention generally relates to a cable connector assembly, and more particularly to a cable connector assembly with improved structure strength.

2. Description of Related Art

Nowadays, cable connector assemblies are widely used for connecting two electronic devices with different interfaces. The cable connector assembly usually comprises a cover, an electrical connector, and a cable connected to the electrical connector. The cover includes a top cover, a bottom cover, and a retaining space located therebetween to retain the electrical connector. The electrical connector has a mating port protruding forwardly beyond the cover for mating with a mating connector. The top cover defines a plurality of first positioning posts extending downwardly toward the bottom cover. The bottom cover defines a plurality of second positioning posts corresponding to the first positioning post of the top cover. The second positioning posts each defines a positioning hole adapted to retain the first positioning post therein to ensure the top cover and the bottom cover assembled together. However, the structure strength between the top cover and the bottom cover is weak.

Correspondingly, it is desired to have a cable connector assembly with improved structure strength to address the problems stated above.

BRIEF SUMMARY OF THE INVENTION

According to one aspect of the present invention, a cable connector assembly comprises a top cover defining at least one first positioning post extending downwardly therefrom, a bottom cover being assembled to the top cover in an upper-to-lower direction thereof, an electrical connector including an insulative housing having and a plurality of terminals retained in the housing, at least one insulator cooperating with the top cover and the bottom cover to commonly define a retaining space to retain the electrical connector, and a cable connected to the terminals and extending beyond the top cover and the bottom cover. The first positioning post has a positioning hole. The bottom cover has at least one second positioning post extending upwardly toward the top cover and retained into the positioning hole of the positioning post of the top cover. The insulator defines a retaining slot passing therethrough along the upper-to-lower direction to retain the first positioning post of the top cover therein;

According to one aspect of the present invention, a cable connector assembly comprises a metal top cover defining at least one first position post extending downwardly, a metal bottom cover being assembled to the top cover in an upper-to-lower direction thereof, an electrical connector including an insulative housing and a plurality of terminals received in the housing, at least one insulator sandwiched between the top cover and the bottom cover along the upper-to-lower direction, and a cable connected to the terminals and extending beyond the top cover and the bottom cover. The bottom cover has at least one second positioning post extending toward the top cover and retained into the positioning hole of the top cover. The insulator cooperates with the top cover and the bottom cover to define a retaining space to retain the electrical connector therein. The insulator defining a retaining slot to retain the first positioning post and the second positioning post therein.

Other objects, advantages and novel features of the invention will become more apparent from the following detailed description of the present embodiment when taken in conjunction with the accompanying drawings.

DETAILED DESCRIPTION OF THE INVENTION

Figure 1:
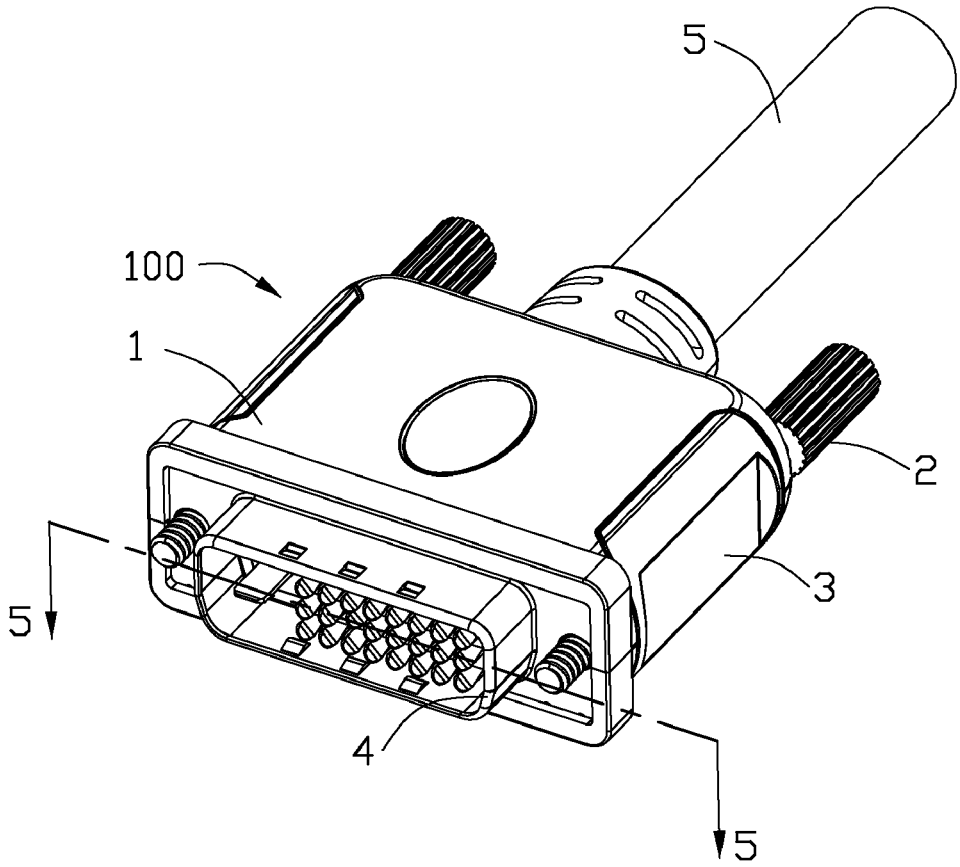
FIG. 1 is an assembled, perspective view of a cable connector assembly according to an embodiment of the present invention.

Reference will now be made to the drawing figures to describe the present invention in detail.

Figure 2:
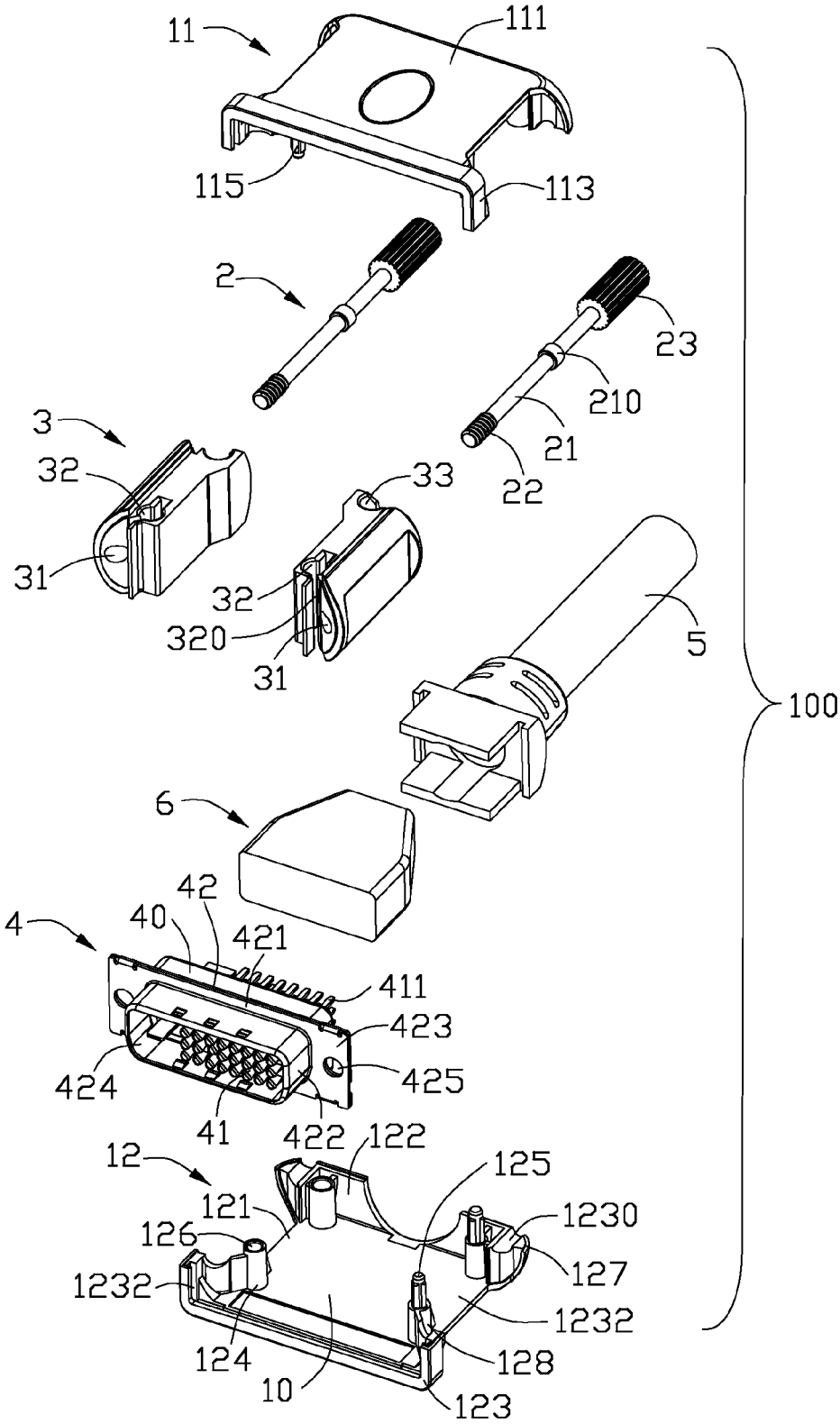
FIG. 2 is an exploded view of the cable connector assembly shown in FIG. 1.
Figure 3:
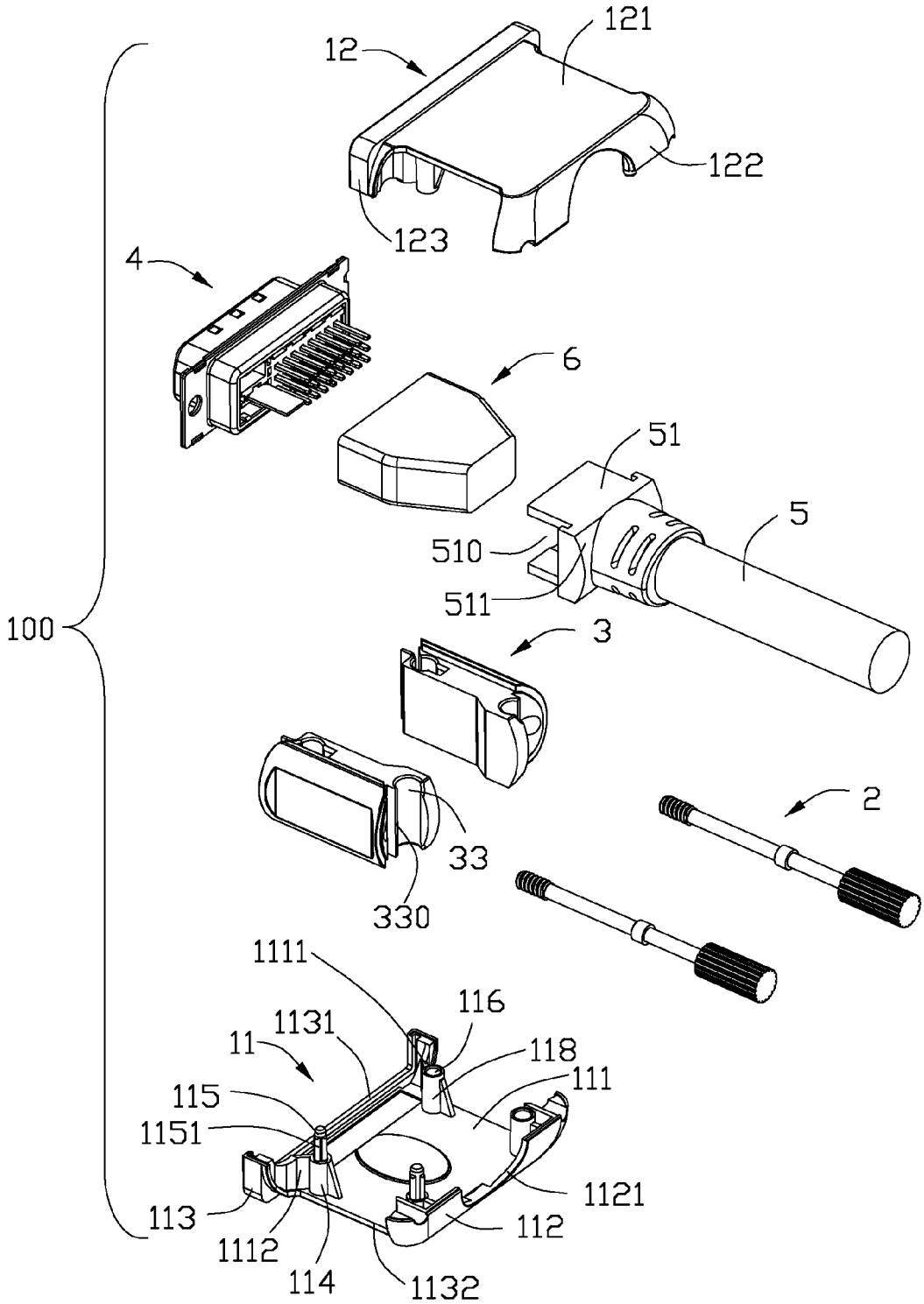
FIG. 3 is similar to FIG. 2, but viewed from another aspect.
Figure 4:
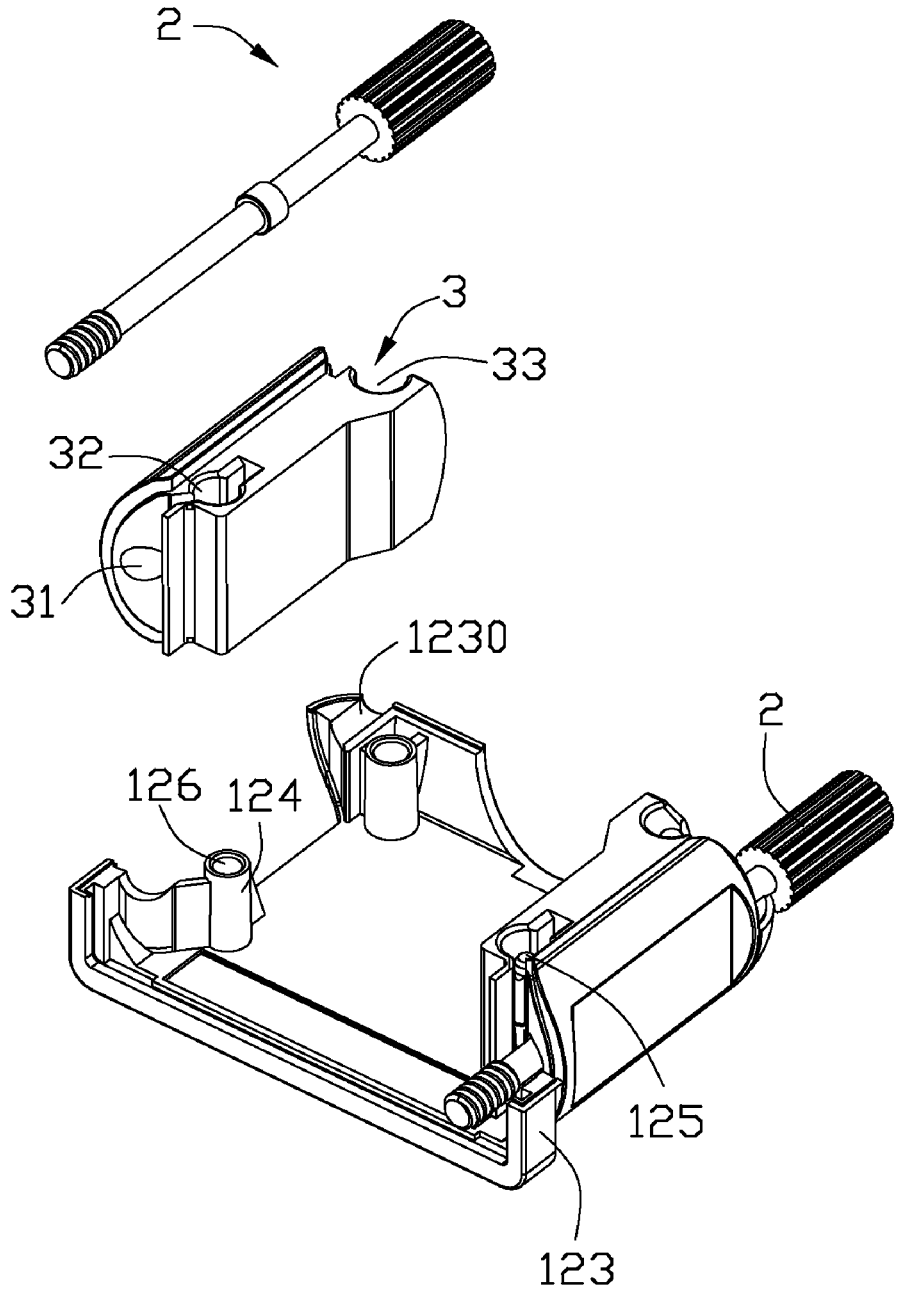
FIG. 4 is a perspective view of a bottom cover, a screw and an insulator of the cable connector assembly shown in FIG. 1.
Figure 5:
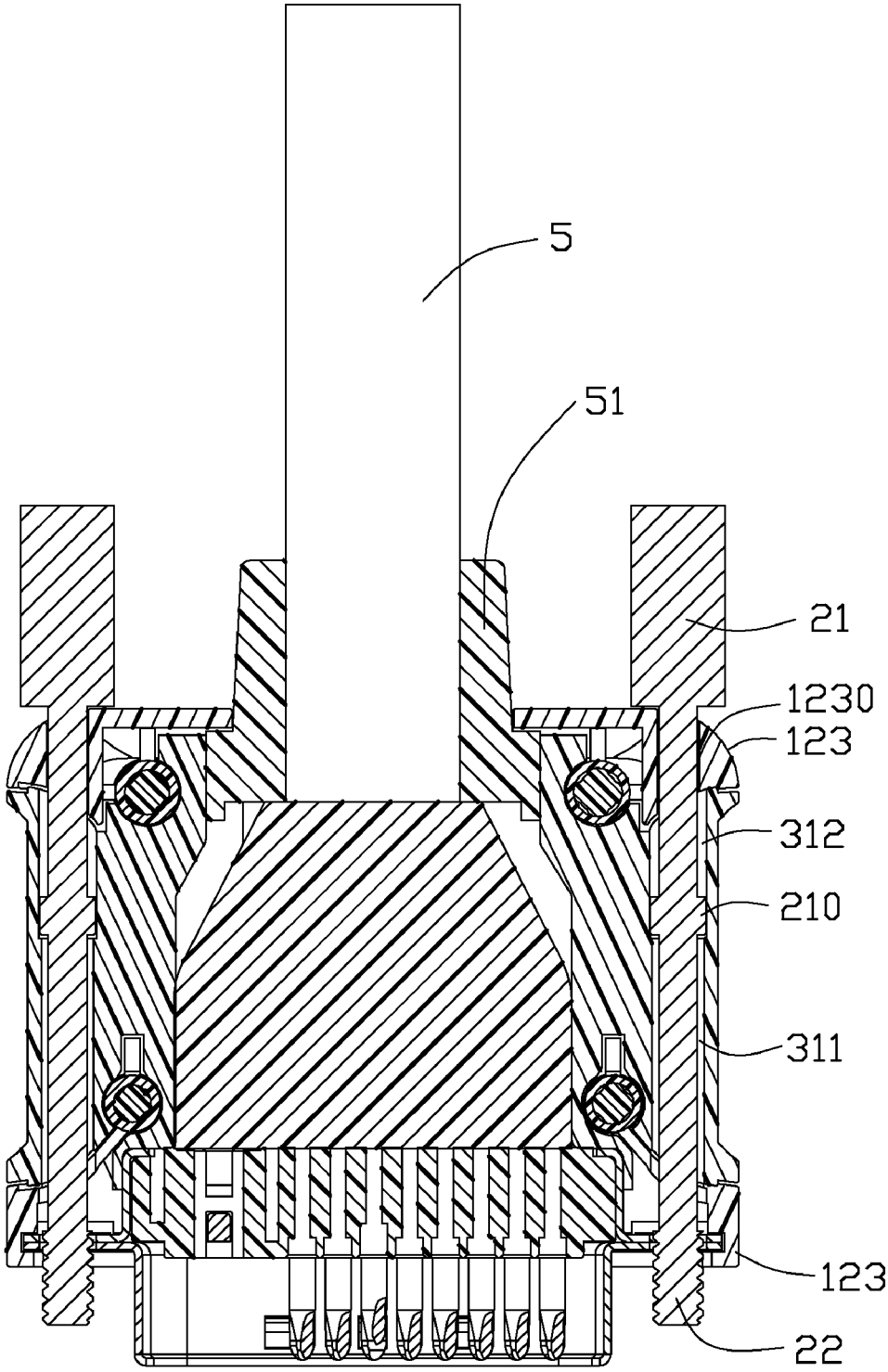
FIG. 5 is a cross-sectional view of the cable connector assembly taken along line 5-5 of FIG. 1.

Referring to FIGS. 1-5, a cable connector assembly 100 in accordance with the present invention comprises a cover 1, a pair of metal screws 2, a pair of insulators 3, an electrical connector 4, a cable 5 connected to the electrical connector 4, and an insulative block 6. The cover 1 is made of metallic material, and comprises a top cover 11 and a bottom cover 12 assembled to the top cover 11 along an upper-to-lower direction thereof.

The electrical connector 4 is compatible with Digital Visual Interface (DVI) transmitting protocol, and includes an insulative housing 40, a plurality of terminals 41 retained in the insulative housing 40, and a metal shell 42 covering the insulative housing 40. The insulative housing 40 is sandwiched between the pair of insulators 3 in a laterally direction perpendicular to the upper-to-lower direction. The pair of insulators 3 press forwardly against the insulative housing 40 for preventing the electrical connector 4 from moving rearwardly. The shell 42 includes a base 421, a mating portion 422 protruding forwardly from the base 421, and two opposite flanges 423 protruding laterally from the base 421 respectively. The mating portion 422 forms a font mating port 424 for receiving a mating connector(not shown). The flanges 423 each defines a through securing hole 425 locking with the screw 2. The terminals 41 each defines a soldering tail 411 soldered to the cable 5.

A retaining space 10 is surrounded by the cover 1 and the pair of insulators 3 to retain the electrical connector 4 and the cable 5 therein. The top cover 11 includes a rectangle shape top wall 111, a rear wall 112 bending downwardly from the top wall 111, a pair of side walls 113 bending downwardly from the top wall 111 and connected to the rear wall 112, a pair of first positioning posts 118, a pair of enlarging portions 114 which extending downwardly from the top wall 111, and a pair of second positioning posts 115 extending downwardly from the enlarging portions 114 respectively. The top cover 11 has a first opening 1131 disposed among the top wall 111 and the side walls 113, a second opening 1121 opposited to the first opening 1131. The first opening 1131 extends into the top wall 111 and the side walls 113, but not passes through the top wall 111 and the side walls 113. The second opening 1121 passes through the rear wall 112. The openings 1131, 1121 are in communication with the retaining space 10.

The pair of side walls 113 each defines a cutout 1132 passing therethrough into the retaining space 10 and adapted to retain the insulator 3. The first positioning posts 118 each defines a positioning hole 116, and has a same dimension with the enlarging portion 114. The first positioning posts 118 and the second positioning posts 115 are disposed on four apexes of a rectangle at end of the top wall 111 respectively. The second positioning posts 115 each defines a plurality of vertical ribs 1151 on an outer surface thereof. The top cover 11 defines a first vertical reinforce wall 1111 connected to the first positioning post 118, the top wall 111 and the side wall 113, and a second vertical reinforce wall 1112 connected to the enlarging portion 114, the top wall 111 and the side wall 113.

The bottom cover 12 is similar to the top cover 11, and includes a pair of first positioning posts 124 corresponding to the pair of second positioning posts 115 of the top cover 111, and a pair of second positioning posts 125 corresponding to the pair of first positioning posts 118 respectively. The first positioning posts 124 each defines a positioning hole 126 adapted to retain the second positioning post 115 therein. The second positioning posts 125 each is retained into the positioning hole 116 of the first positioning 118 of the top cover 11. The bottom cover 12 includes a bottom wall 121 opposited to the top wall 111 of the top cover 11, a pair of side walls 123 and a rear wall 122 all of which bend upwardly from the bottom wall 121, and an enlarging portion 128 extending upwardly from the bottom wall 121 to the second positioning post 125. The pair of side walls 123 each defines a cutout 1232 formed together with the cutout 1132 of the top cover 11 to form a chamber for retaining the insulator 3 to prevent the insulator 3 from moving along the front-to-rear direction and the upper-to-lower direction. The pair of side walls 123 each combines with the side wall 113 of the top cover 11 to form a pair of circular holes 1230 passing through the side walls 113, 123 along the front-to-rear direction. The cutout 1132 is disposed between the pair of circular holes 1230.

The insulators 3 are sandwiched between the top cover 11 and the bottom cover 12 along the upper-to-lower direction, and each defines a locating hole 31 passing therethrough along the front-to-rear direction, a first retaining slot 32 disposed at a front end thereof, a second retaining slot 33 disposed at a rear end thereof. The first retaining slot 32 and the second retaining slot 33 extend through the insulator 3 along the upper-to-lower direction respectively. The first retaining slot 32 defines a first gap 320 extending to exterior of the insulator 3. The second retaining slot 33 defines a second gap 330 extending to exterior of the insulator 3. The locating hole 31 is disposed in an outer side of the first retaining slot 32 and the second retaining slot 33. The locating hole 31 is divided into a front locating hole 311 and a rear locating hole 312 whose dimension is wider than the front locating hole 311.

The screws 2 each includes a middle portion 21 received into the locating hole 31, a thread portion 22 locking in the securing hole 425 of the shell 42 of the electrical connector 4 and protruding forwardly beyond the flange 423 for latching with the mating connector, and a rotating portion 23 disposed on a rear end thereof for rotating the screw 2. The middle portion 21 defines a circular ring 210 surrounding an outer side wall thereof and received in the rear locating hole 312 of the insulator 3 for preventing the screw 2 from over-moving along the front-to-rear direction.

The cable 5 includes a strain relief portion 51 on a front end thereof and a plurality of wires (not shown) connected to the soldering tails 411 of the terminals 41 of the electrical connector 4. The block 6 is insert molded with the soldering tails 411. The strain relief portion 51 defines a cavity 510 extending forwardly therethrough to retain the block 6 therein, and a rear plate 511 enclosing the cavity 510. The block 6 is sandwich between the pair of insulators 3 in the laterally direction. The rear plate 511 is located in the retaining space 10 and is pressed against by an inner wall of the rear walls 112, 122 of the cover 1 for preventing the cable 5 from breaking away from the electrical connector 4.

After the cable connector assembly 100 is assembled, the second positioning posts 115, 125 of one of the top cover 11 and the bottom cover 12 that are retained into the positioning holes 126, 116 of the first positioning posts 118, 124 of the other one of the top cover 11 and the bottom cover 12 respectively. The first positioning posts 118, 124 presses against the corresponding enlarging portions 114, 128 which are connected to the second positioning post 115, 125 along the upper-to-lower direction. The enlarging portions 114, 128 and the first positioning post 118, 124 of one of the top cover 11 and the bottom cover 12 are retained in the first retaining slot 32 and the second retaining slot 33 of the insulators 3 respectively to ensure the top cover 11 combined with the bottom cover 12 reliably.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly, comprising:

a top cover defining at least one first positioning post extending downwardly therefrom, the first positioning post having a positioning hole;

a bottom cover being assembled to the top cover in an upper-to-lower direction thereof, the bottom cover having at least one second positioning post extending upwardly toward the top cover and retained into the first positioning hole of the first positioning post of the top cover;

an electrical connector including an insulative housing, and a plurality of terminals retained in the housing;

at least one insulator cooperating with the top cover and the bottom cover to commonly define a retaining space to retain the electrical connector, the insulator defining a retaining slot passing therethrough along the upper-to-lower direction to retain the first positioning post of the top cover therein; and a cable connected to the terminals and extending beyond the top cover an the bottom cover.

2. The cable connector assembly as claimed in claim 1, further comprises a metal screw being adapted to ensure the electrical connector assembled to the top cover and the bottom cover, the screw includes a middle portion retained into a locating hole of the insulator, and two opposite end portions being sandwiched by the top cover and the bottom cover, the locating hole extends through the insulator along a front-to-rear direction of the cable connector assembly.

3. The cable connector assembly as claimed in claim 2, wherein the electrical connector includes a metal shell enclosing the insulative housing, the shell defines a flange extending laterally and secured between the top cover and the bottom cover, the flange defines a through securing hole, the screw defines a thread portion disposed at one end thereof and secured in the securing hole, the thread portion also protrudes forwardly beyond the flange for locking with an mating connector, the flange is sandwiched between the top cover and the bottom cover.

4. The cable connector assembly as claimed in claim 3, wherein the top cover and the bottom cover have a circular hole therebetween to receive another end of the screw, the locating hole includes a front locating hole and a rear locating hole disposed between the front locating hole and the circular hole, the middle portion of the screw defines a circular ring portion which could move in the rear locating hole, both of the front locating hole and the circular hole are narrower than the rear locating hole for preventing the screw from over-moving along the front-to-rear direction.

5. The cable connector assembly as claimed in claim 1, wherein the top cover includes a top wall, two first opposited side walls bending downwardly from the top wall, and a vertical reinforcement wall connected with the top wall, the side wall and the first positioning post, the top wall and the side walls surround the retaining space, the first positioning post is disposed in an inner side of one of the side walls and extends from the top wall.

6. The cable connector assembly as claimed in claim 5, wherein the first side wall defines a first cutout passing therethrough and in communication with the retaining space, the insulator is located in the first cutout, the insulator defines a gap being adapted to receive the reinforcement wall, the gap extends to exterior of the insulator from the first positioning hole.

7. The cable connector assembly as claimed in claim 6, wherein the bottom cover includes a bottom wall opposited to the top wall of the top cover, a second side wall engaging with the first side wall of the top cover, and an enlarging portion extending downwardly from the top wall to the second position post, the enlarging portion presses upwardly against the first positioning post for preventing the top cover from moving downwardly.

8. The cable connector assembly as claimed in claim 7, wherein the enlarging portion and the first positioning post of the top cover have the same dimension, the enlarging portion is retained into the first positioning hole of the top cover, the second side wall defines a second cutout passing therethrough, the first cutout and the second cutout form together as a chamber for retaining the insulator to prevent the insulator from moving in both the front-to-rear direction and the upper-to-lower direction.

9. The cable connector assembly as claimed in claim 1, wherein the terminals each includes a soldering tail, the cable includes a strain relief portion on a front segment thereof and a plurality of wires, the cable connector assembly further includes an insulative block being insert molded over the solder tails and the wires, the strain relief defines a cavity to retain the block therein and a rear plate enclosing the cavity, the rear plate is located into the retaining space to prevent the cable from breaking away from the electrical connector, the insulator presses laterally against the block for preventing the block from moving in a laterally direction perpendicular to the front-to-rear direction.

10. The cable connector assembly as claimed in claim 1, wherein the top cover and the bottom cover each has a pair of first positioning posts and a pair of second positioning posts, the first positioning posts are secured with the second positioning posts respectively, the posts are arranged on four apexes of an rectangle at end of the top cover or the bottom cover respectively.

11. A cable connector assembly, comprising:

a metal top cover defining at least one first position post extending downwardly therefrom;

a metal bottom cover being assembled to the top cover in an upper-to-lower direction thereof, the bottom cover having at least one second positioning post extending upwardly toward the top cover;

an electrical connector including an insulative housing having a plurality of terminals received therein;

at least one insulator sandwiched between the top cover and the bottom cover along the upper-to-lower direction, the insulator cooperating with the top cover and the bottom cover to form a retaining space to retain the electrical connector therein, the insulator defining at least two retaining slots to retain the first positioning post and the second positioning post therein respectively; and a cable connected to the terminals and extending beyond the top cover and the bottom cover.

12. The cable connector assembly as claimed in claim 11, further comprises a metal screw adapted to retain the electrical connector, the insulator, the top cover and the bottom cover together, the top cover cooperates with the bottom cover to define an circular hole to receive one end of the screw therein, the insulator defines a locating hole passing therethrough to retain a middle portion extending from the end of screw, the middle portion of the screw is movable in the locating hole of the insulator.

13. The cable connector assembly as claimed in claim 11, the cable connector assembly includes a pair of insulators, the insulative housing is sandwiched between the pair of insulators in a laterally direction, the pair of insulators press forwardly against the insulative housing for preventing the electrical connector from moving rearwardly.

14. An electrical cable connector assembly comprising:

an electrical connector including an insulative housing enclosed by a metallic shell and enclosing a plurality of contacts therein to define a mating port thereof, each of said contacts defining a front mating end exposed in the mating port and a rear mounting end in a front-to-back direction;

a cable including a plurality of wires electrically connected to the rear mounting ends of the corresponding contacts, respectively;

a pair of covers sandwiching said insulative housing and said wires therebetween in a vertical direction perpendicular to said front-to-back direction;

a pair of insulators discrete from both said electrical connector and said pair of covers while being sandwiched immoveably between said covers and located on two opposite lateral sides behind the electrical connector; and a pair of screws extending respectively through the corresponding insulators in said front-to-back direction each of said screws defining a front threaded end exposable beyond a front end of the corresponding insulator when the screw is moved to a foremost position.

15. The electrical cable connector assembly as claimed in claim 14, wherein each screw defines a ring structure adapted to be stopped by one of the cover when said screw is moved to a rearmost position.

16. The electrical cable connector assembly as claimed in claim 14, wherein each of said insulator is assembled to one of the cover in said vertical direction.

17. The electrical cable connector assembly as claimed in claim 16, wherein one of the insulator and the cover defines a post structure and the other defines a tubular structure receiving said post therein.

* * * * *